US008955452B1

(12) United States Patent
Wilson

(10) Patent No.: US 8,955,452 B1
(45) Date of Patent: Feb. 17, 2015

(54) ADJUSTABLE PLANING DEVICE FOR PONTOON BOATS

(71) Applicant: Harley Wilson, Indianapolis, IN (US)

(72) Inventor: Harley Wilson, Indianapolis, IN (US)

( * ) Notice: Subject to any disclaimer, the term of this patent is extended or adjusted under 35 U.S.C. 154(b) by 0 days.

(21) Appl. No.: 14/219,580

(22) Filed: Mar. 19, 2014

Related U.S. Application Data

(60) Provisional application No. 61/907,184, filed on Nov. 21, 2013.

(51) Int. Cl.

| | |
|---|---|
| ***B63B 1/12*** | (2006.01) |
| ***B63B 1/18*** | (2006.01) |
| ***B63B 1/20*** | (2006.01) |
| ***B63B 1/22*** | (2006.01) |
| ***B63B 35/34*** | (2006.01) |

(52) U.S. Cl.
CPC . *B63B 1/22* (2013.01); *B63B 35/34* (2013.01); *B63B 1/12* (2013.01); *B63B 1/121* (2013.01); *B63B 1/20* (2013.01)
USPC ..... 114/284; 114/61.1; 114/292

(58) Field of Classification Search
CPC ..... B63B 1/10–2001/145; B63B 1/16–1/30
USPC ..... 114/61.1–61.25, 67 A, 127–139, 271, 114/274–287, 292; 180/116, 117
See application file for complete search history.

(56) References Cited

U.S. PATENT DOCUMENTS

| | | | | |
|---|---|---|---|---|
| 1,265,035 | A | 5/1918 | Bazaine | |
| 1,273,549 | A * | 7/1918 | Sloper | 244/101 |
| 2,950,699 | A | 8/1960 | Ogden et al. | |
| 3,146,752 | A * | 9/1964 | Ford | 114/67 A |
| 3,289,226 | A | 12/1966 | Thompson | |
| 3,998,176 | A | 12/1976 | Stout et al. | |
| 4,067,286 | A | 1/1978 | Stout et al. | |
| 4,348,977 | A | 9/1982 | Okajima | |
| 4,351,262 | A | 9/1982 | Matthews | |
| RE31,563 | E | 4/1984 | Stout et al. | |
| 4,494,477 | A | 1/1985 | Matthews | |
| 4,655,157 | A * | 4/1987 | Sapp | 114/291 |
| 4,669,408 | A | 6/1987 | Schad | |
| 4,821,663 | A | 4/1989 | Schad | |
| 4,883,012 | A * | 11/1989 | Kennedy | 114/61.1 |
| 4,896,621 | A | 1/1990 | Coles | |

(Continued)

OTHER PUBLICATIONS

Pontoon Water Glide. [retrieved Nov. 21, 2013]. Retrieved from the Internet: <URL: http://www.pontoonwaterglide.com/history.asp>.

*Primary Examiner* — Ajay Vasudeva
(74) *Attorney, Agent, or Firm* — Woodward, Emhardt, Moriarty, McNett & Henry LLP

(57) ABSTRACT

A hydraulically adjustable planing device mounted midship on a pontoon boat to provide lift to the pontoon boat and reduce drag. The adjustable planing device includes a modular frame and an adjustable planing plate. A front end of the planing plate is rotatably attached to a front member of the modular frame such that the planing plate is movable between a raised position wherein the planing plate is above the waterline and a lowered position wherein a rear end of the planing plate engages the waterline to lift the pontoon boat. In another form, the adjustable planing device includes two or more longitudinally extending planing plates that are individually operable between raised and lowered positions to provide lateral trimming and improved steering of the boat. Optionally, a single skirt plate is attached to each rear end of the single or multiple planing plate(s) for additional lift for longer pontoon boats.

18 Claims, 13 Drawing Sheets

(56) References Cited

U.S. PATENT DOCUMENTS

| | | | |
|---|---|---|---|
| 4,951,591 | A | 8/1990 | Coles |
| 5,259,331 | A | 11/1993 | Hagan |
| 5,465,678 | A | 11/1995 | Ekman |
| 6,016,762 | A | 1/2000 | Price |
| 6,482,056 | B1 | 11/2002 | Schell-Tomczak et al. |
| 7,182,033 | B1 | 2/2007 | Phillips et al. |
| 7,204,196 | B2 | 4/2007 | Coles |
| 7,913,636 | B2 | 3/2011 | Meyer |
| 2006/0162639 | A1 | 7/2006 | Costello |
| 2011/0132251 | A1 | 6/2011 | Wilson |

* cited by examiner

ADJUSTABLE PLANING DEVICE FOR PONTOON BOATS

CROSS-REFERENCE TO RELATED APPLICATION

This application claims the benefit of U.S. Provisional Application No. 61/907,184 filed Nov. 21, 2013, which is hereby incorporated by reference.

BACKGROUND

The present invention relates to an adjustable planing device that is attached to a midship region of a pontoon boat to provide more lift and reduce drag of the pontoon boat. Existing mechanisms that attach to a pontoon boat or other watercraft for adjusting the lift and drag of the pontoon boat or other watercraft are available. One mechanism includes a pair of foils that are attached to an undersurface of a pontoon boat at the rear end of the boat wherein each is positioned between a respective pontoon and a motor mount. Another mechanism includes attaching a planing foil to a catamaran boat wherein the foil is positioned between the waterline and the lower surfaces of the hulls or floats when the boat is at rest so that the planing foil rises toward a planing position on the surface of the water as the catamaran boat is propelled therealong in order to lift the boat and reduce drag. Thus, there is a need for improvement in this field.

SUMMARY

The invention is defined in the claims, and only the claims. This summary is not limiting. For owners and enthusiasts of pontoon boats, round bottoms on the typical outboard pontoon offer poor surface area for lift. The adjustable planing device disclosed herein is for outboard, inboard and sterndrive (outdrive) powered pontoon boats. There are many benefits of the adjustable planing device disclosed herein. One benefit is the adjustable planing device increases the speed of the pontoon boat with the existing motor of the pontoon boat. A corresponding benefit is the boat owner saves money since the boat owner does not have to purchase a higher horsepower motor to increase the speed of the boat. Instead, the boat owner typically uses the existing motor on their pontoon boat and simply mounts the adjustable planing device to their pontoon boat. By using the adjustable planing device, the pontoon boat will require less or the same horsepower to push the boat through the water at a faster speed. The planing device offers pontoon boat owners a means of increasing boat speed when they are running maximum legal horsepower engine on their pontoon boat. Another benefit of the adjustable planing device is to offer a modular device to pontoon boat owners that is easy to install and provides more surface area for contact with the water which in turn provides more lift (reducing drag) that results in more speed and better fuel economy. Another result and benefit is that the adjustable planing device will require less horsepower for more top end speed of the pontoon boat.

A unique design of the adjustable planing device, which will be described in greater detail below, has been developed to address these as well as other issues. The adjustable planing device provides a planing plate or surface that can be raised and lowered to account for different gross weights of the pontoon boat, passengers, and cargo to obtain the optimum speed and boat attitude. In one embodiment, one or more double acting hydraulic cylinders are used to raise and lower the planing plate that is hinged at the front end to a modular frame. The modular frame is attached to the underside of the pontoon boat in about the midship region of the boat. The modular frame is configured to attach to various locations of the midship region of the boat. The lift cylinder(s) provide enough power to raise the weight of the boat, people, equipment and the water pressure against it and the design of the hydraulic system locks the cylinders in the selected position. The planing plate can be lowered and locked from its starting position or be raised and lowered while under power or while the pontoon boat is moving.

Since the adjustable planing device is modular in design, the adjustable planing device can be removed from a first pontoon boat and installed on a replacement pontoon boat should the user elect to do so. Installation of the adjustable planing device does not require significant modification of the structure of the boat. Instead, simply drilling holes in the pontoon cross members for attachment with mechanical fasteners to the modular frame are the only mounting requirements. In one embodiment, the adjustable planing device includes a hydraulic power system for moving the planing plate. Components of the power system can be mounted inside any storage area (normally under a seat) of the pontoon boat. Another benefit of installing the adjustable planing device on a pontoon boat is by changing the attitude of the pontoon boat, there is an increase in speed and better fuel economy of the pontoon boat. In one embodiment, a trim indicator gauge is added on the dash of the pontoon boat that lets the operator know the position or angle of the planing plate. The trim indicator provides a visual aid for the boat operator on the position of the planing plate for optimum performance for different loads on the pontoon boat and water conditions.

Another embodiment of the adjustable planing device includes a first longitudinal planing plate and a second longitudinal planing plate positioned in a side by side orientation and rotatably attached to a modular frame. In this embodiment, the first and the second longitudinal planing plates operate independently of each other. Beneficially, this independent operation provides lateral trimming and improved steering of the pontoon boat.

In yet another embodiment, a skirt plate is attached to the rear end of the planing plate to provide additional surface contact area of the planing plate. Beneficially, the skirt plate provides additional lift to the pontoon boat.

In other embodiments, the adjustable planing device is installed on a tritoon boat or boats with three or more pontoons. Beneficially, the adjustable planing device provides independent trimming and improved steering as well as increased performance.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
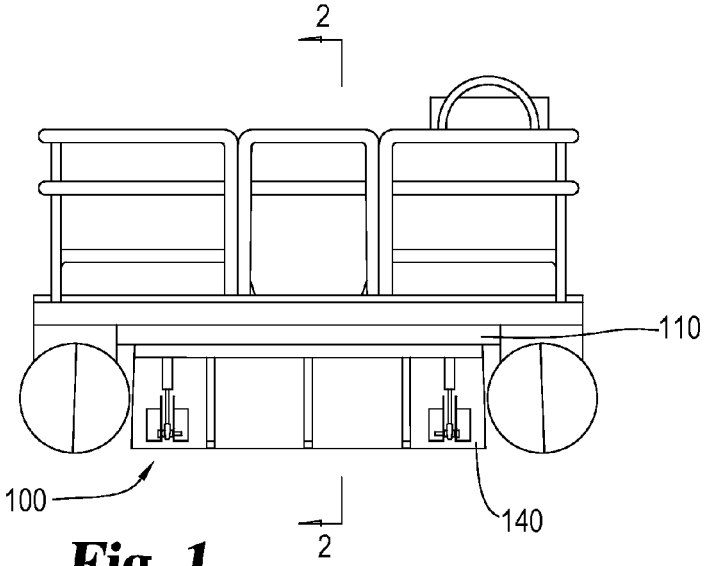
FIG. 1 is a rear view of an adjustable planing device mounted to a pontoon boat.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
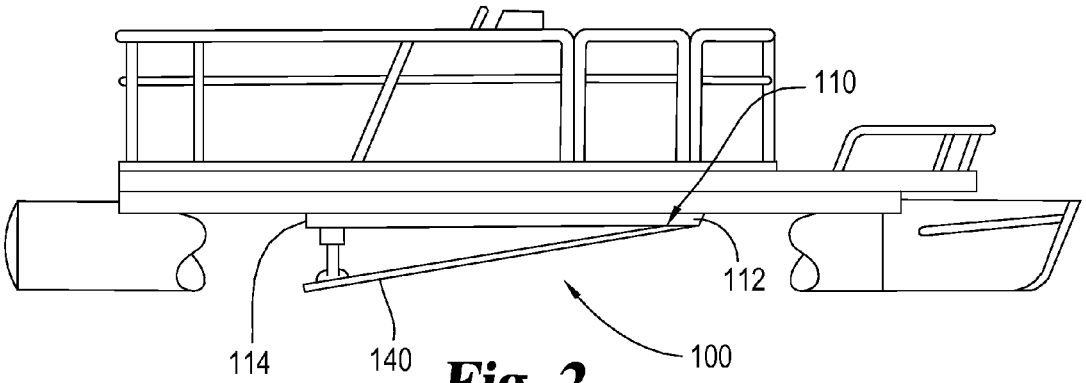
FIG. 2 is a cross-sectional view of the FIG. 1 embodiment.

A first embodiment of an adjustable planing device 100 is illustrated in FIGS. 1-9. In FIGS. 1 and 2, the adjustable planing device 100 is attached to a pontoon boat. More specifically, the pontoon boat has a midship region that spans between a front end and a rear end. The adjustable planing device 100 includes a modular frame 110 and a planing plate 140.

As illustrated in FIGS. 1-4, the modular frame 110 is configured to attach to the midship region of the pontoon boat. As such, the modular frame 110 has a front member 112 opposite a rear member 114 and a right member 116 opposite a left member 118 wherein the right and the left members 116 and 118 span between the front member 112 and the rear member 114. In this embodiment, the modular frame 110 includes a cross member 120 that spans between the right and the left members 116 and 118, respectively. In other embodiments, the modular frame 110 includes additional cross members 120 that span between the right and the left members 116 and 118. In some embodiments, the length of each of the right and the left members 116 and 118 and the length of each of the front and the rear members 112 and 114 is sized to accommodate a particular sized pontoon boat. In the illustrated embodiment, the right and left members 116 and 118 and the front and the rear members 112 and 114 have a channel or C cross-sectional shape. However, other embodiments can include different cross-sectional shapes such as, but not limited to, L-shaped angles, I-beams, tubes, and/or rectangular shapes.

Figure 8:
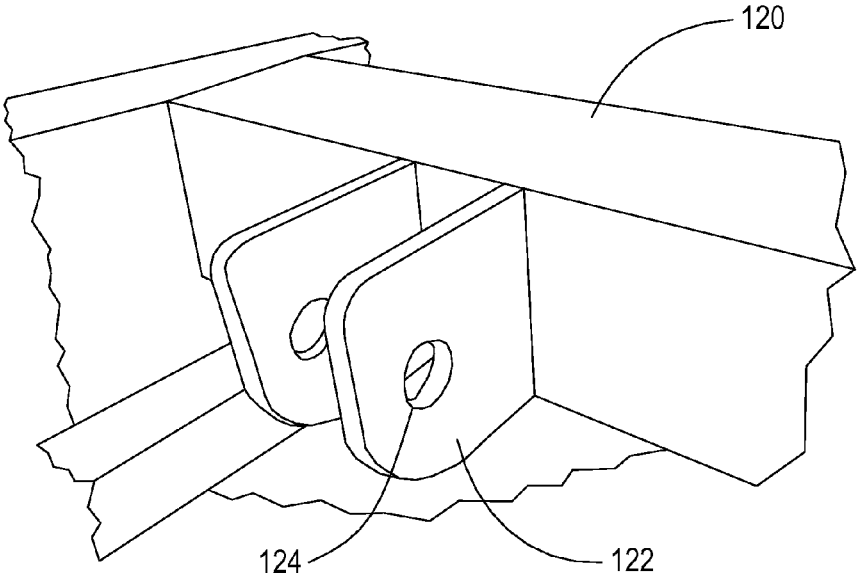
FIG. 8 is a side perspective view of a pair of mounting plates of the modular frame of the adjustable planing device from FIG. 1.

As illustrated in FIG. 8, the cross member 120 includes a pair of mounting plates 122 configured for attachment of a hydraulic cylinder or other mechanism that is configured to move the planing plate 140. As described below, the hydraulic cylinder or other mechanism is also attached to the planing plate 140. In this embodiment, each of the mounting plates 122 includes a hole 124 sized to receive a bolt or other mechanical device to attach the hydraulic cylinder thereto. In one embodiment, one or more of the front member 112, the rear member 114, the right member 116, the left member 118, and/or the cross member 120 includes a plurality of holes 125 sized to receive a bolt or other mechanical fastener to connect the corresponding member of the modular frame 110 to the pontoon floor and/or the existing structural cross members of the pontoon boat. The plurality of holes 125 enables the optimum position of the modular frame 110 to be located relative to the pontoon boat and, in one particular embodiment, the modular frame 110 is attached to the midship region of the pontoon boat. Moreover, the plurality of holes 125 enables a single adjustable planing device 100 to be used with any one of differently sized pontoon boats.

In the illustrated embodiment, the modular frame 110 includes a first longitudinal stiffener 126 that spans between the front member 112 and the cross member 120 wherein the first longitudinal stiffener 126 is positioned across from one of the pairs of mounting plates 122. In this form, the modular frame 110 also includes a second longitudinal stiffener 128 that spans between the front member 112 and the cross member 120 wherein the second longitudinal stiffener 128 is positioned across from the other of the pairs of mounting plates 122. In other embodiments the modular frame 110 includes additional longitudinal stiffeners that span between the front member 112 and the cross member 120. Alternatively, the modular frame 110 may not include any longitudinal stiffeners in other embodiments.

Figure 3:
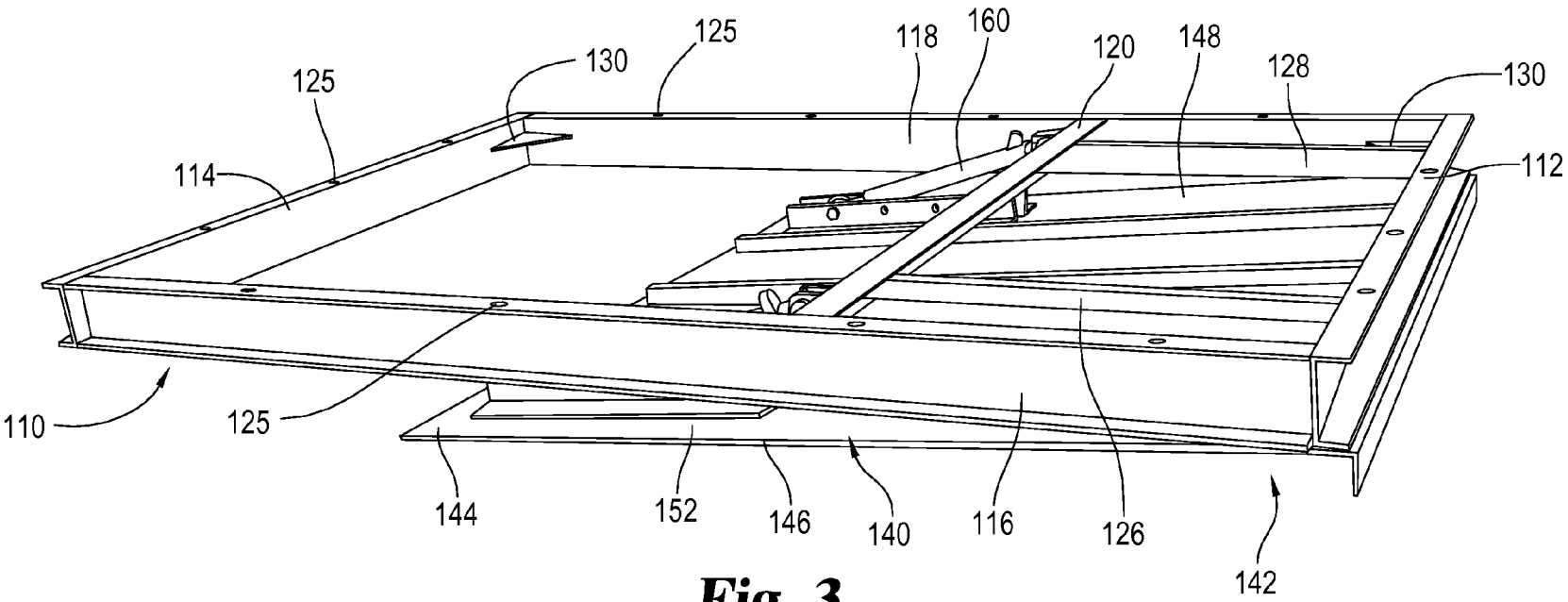
FIG. 3 is a top perspective view of the adjustable planing device from FIG. 1 in a raised position.
Figure 4:
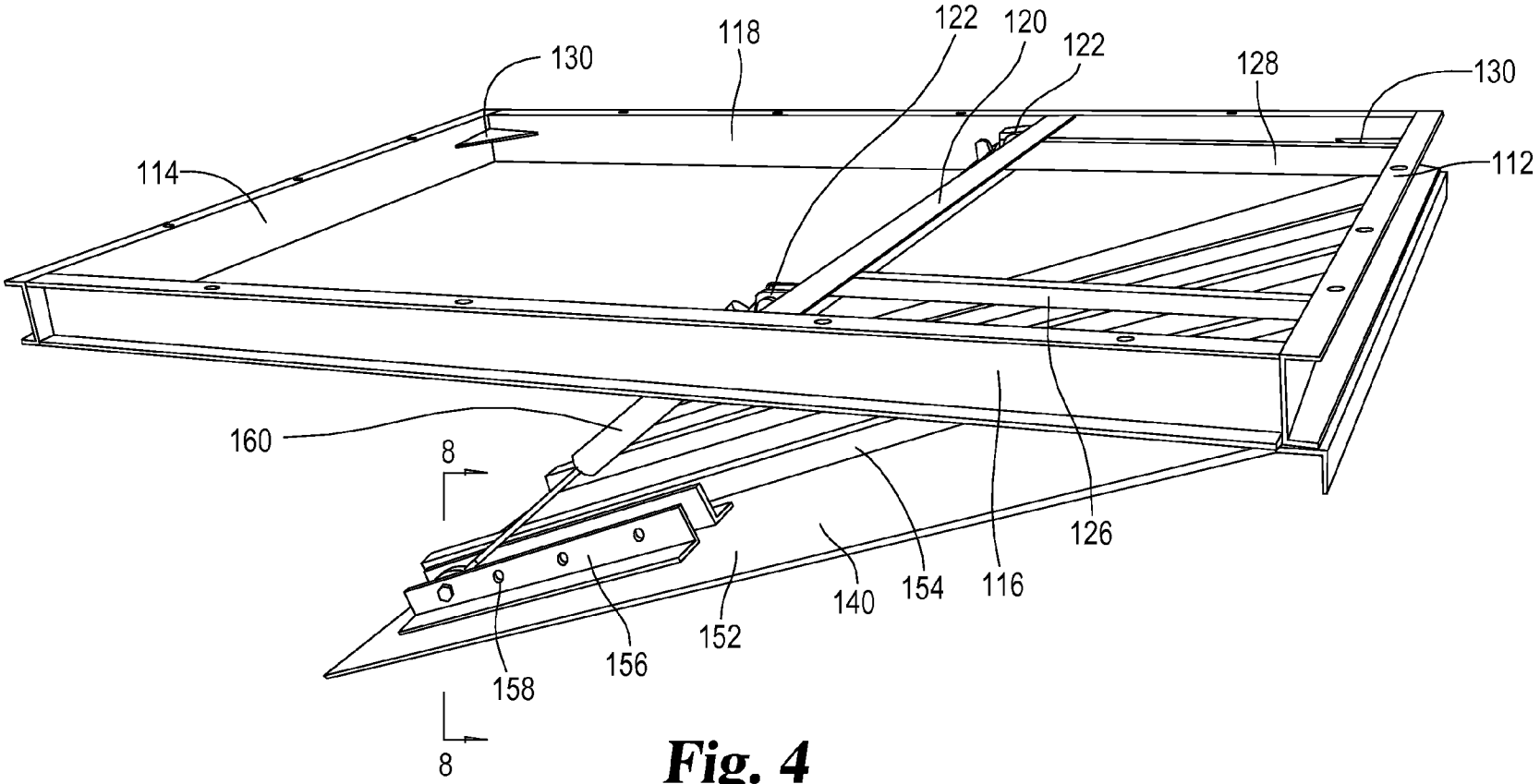
FIG. 4 is a top perspective view of the adjustable planing device from FIG. 1 in a lowered position.

As illustrated in the embodiment in FIGS. 3 and 4, the modular frame 110 includes a stiffener plate 130 that is mounted at each of the joints between the right and the left members 116 and 118 and the front and the rear members 112 and 114. As such, the stiffener plate 130 is mounted at the joint between the right member 116 and the front member 112 and another of the stiffener plate 130 is mounted at the joint between the right member 116 and the rear member 114. Correspondingly, although not illustrated in FIGS. 3 and 4, the modular frame 110 includes a third stiffener plate 130 mounted at the joint between the left member 118 and the front member 112 and a fourth stiffener plate 130 mounted at the joint between the left member 118 and the rear member 114. The stiffener plate 130 has a flat triangular shape; however, other embodiments can include an L-shape, a tube shape, a channel, or other shapes that are configured to reinforce the joint between two members. Other embodiments of the modular frame 110 may not include any stiffener plates.

Figure 6:
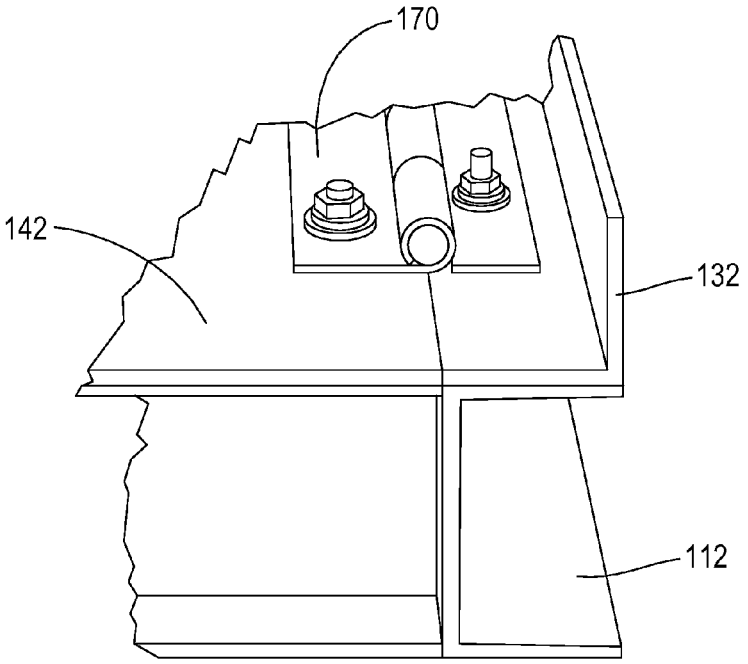
FIG. 6 is a partial side perspective view of a rear end of the adjustable planing device from FIG. 5.

In one embodiment illustrated in FIG. 6, the modular frame 110 includes a stiffener member 132 that is attached to and spans the length of the front member 112. The stiffener member 132 has an angle or L-shape for a cross-sectional shape in the illustrated embodiment but can be configured differently in other embodiments such as a flat plate or a channel shape to name a few. Other embodiments of the modular frame 110 may not include the stiffener member 132.

The modular frame 110 can be made from various materials combinations of materials, such as, metal, aluminum, steel, plastic, and fiberglass, to name a few.

Figure 5:
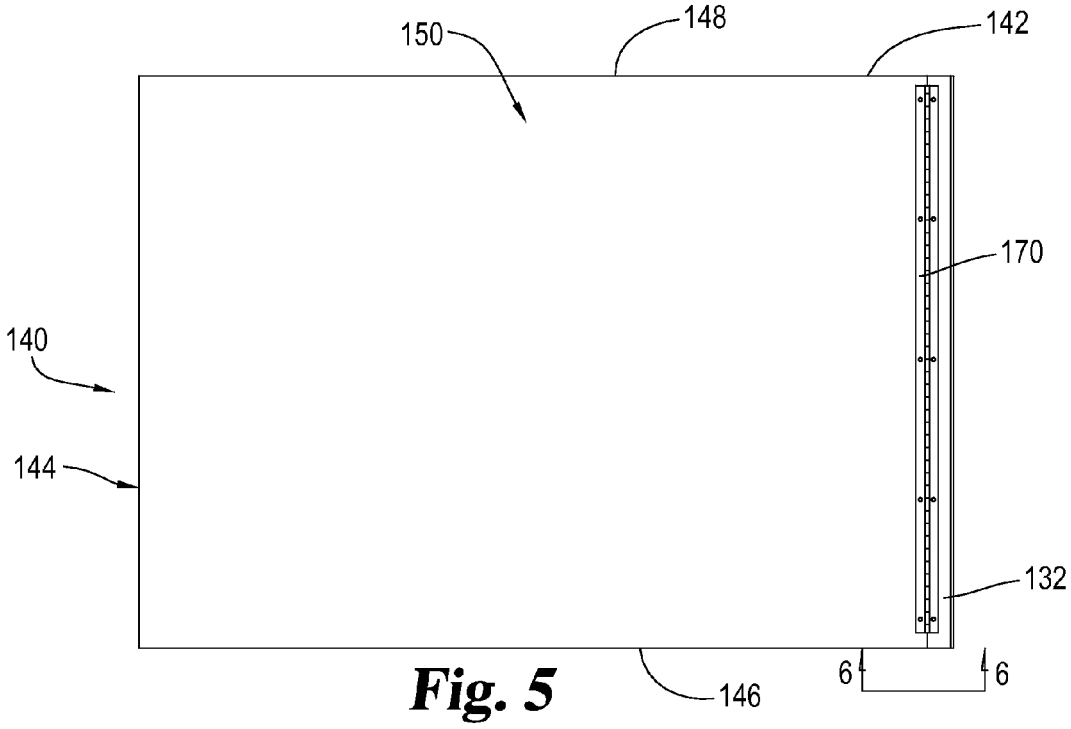
FIG. 5 is a bottom view of a planing plate of the adjustable planing device from FIG. 1.
Figure 7:
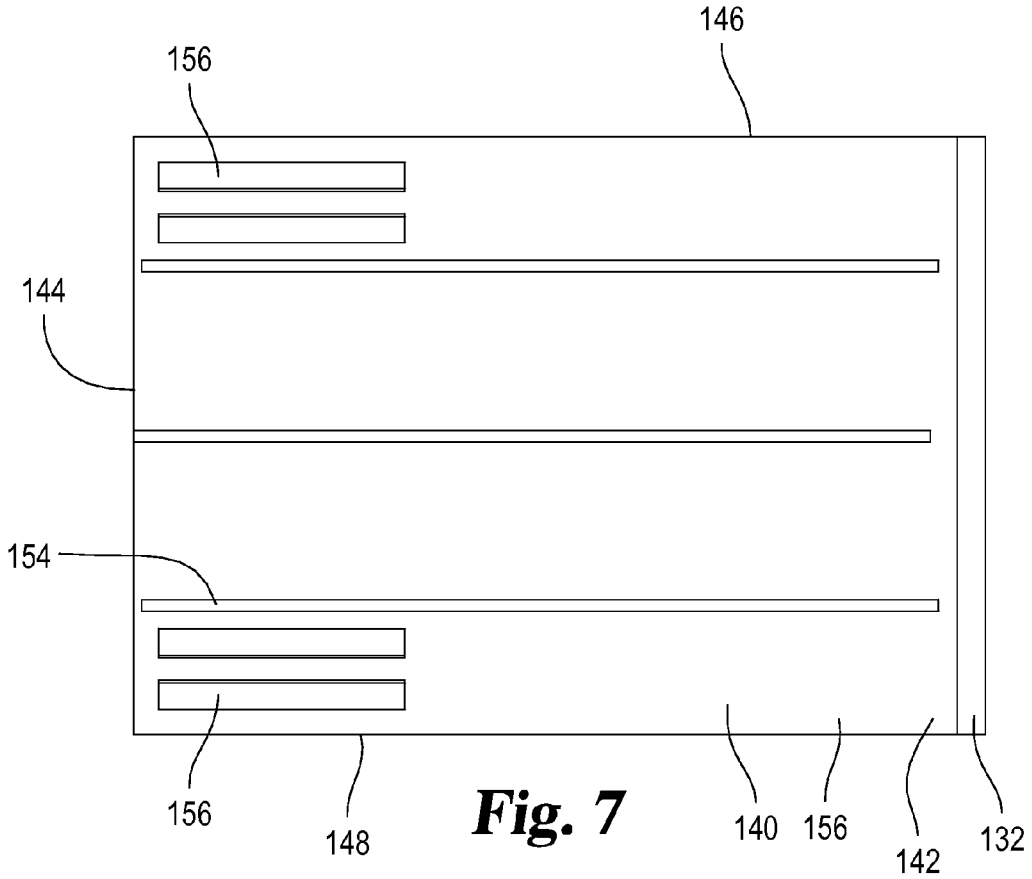
FIG. 7 is a top view of the planing plate of the adjustable planing device from FIG. 1.

As illustrated in FIGS. 5 and 7, the planing plate 140 includes a front end 142 opposite a rear end 144 and a right edge 146 opposite a left edge 148 wherein the right and the left edges 146 and 148, respectively, span between the front and the rear ends 142 and 144. The planing plate 140 also includes a lower planing face 150 opposite an upper planing face 152 wherein the lower and the upper planing faces 150 and 152 span between the front end 142 and the rear end 144 of the planing plate 140. As illustrated in FIG. 5, the lower planing face 150 has a substantially smooth surface to engage the waterline when the pontoon boat is in water. In the illustrated embodiment shown in FIG. 7, the planing plate 140 includes a plurality of spaced support members 154 positioned on the upper planing face 152 wherein the support members 154 are configured to reinforce the planing plate 140. In this form, three support members 154 are attached to the upper planing face 152; however, other configurations may include more or less support members 154. The support members 154 span from the front end 142 to the rear end 144 but in other embodiments may have a shorter length. The support members 154 have a generally rectangular cross-sectional shape, but in other embodiments the support members 154 have a channel shape, an I shape, an L shape, a flat plate, or any other shape that will reinforce the planing plate 140.

Figure 9:
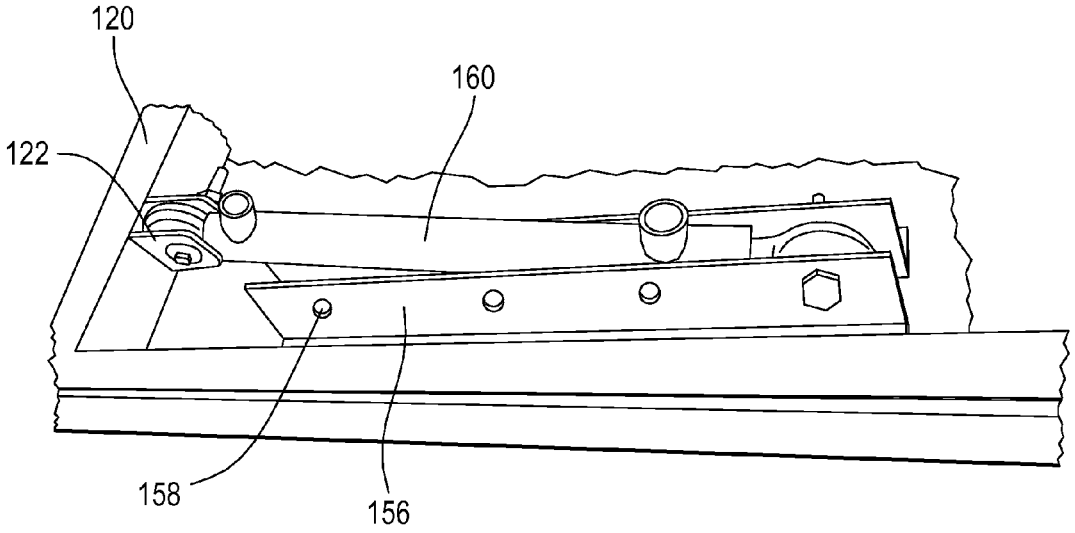
FIG. 9 is one embodiment of a pair of mounting members with multiple holes of adjustably mounting a hydraulic cylinder of the adjustable planing device from FIG. 1.

In the embodiment illustrated in FIGS. 7 and 9, the planing plate 140 includes two pairs of mounting members 156 spaced apart from one another. The pairs of mounting members 156 include one or more holes 158 for mounting one end of a hydraulic cylinder 160 between a pair of the mounting members 156. Other embodiments can include an alternative configuration for attaching the hydraulic cylinder 160 or other mechanical device to the mounting members 156. In the illustrated embodiment, the mounting members 156 are L-shaped but can include other shapes such as channels or I beams. As can be appreciated, the hydraulic cylinders 160 can be mounted either vertical from the modular frame 110 or using a linkage arrangement which can be fabricated to allow the hydraulic cylinder 160 to be mounted in other positions.

The planing plate 140 can be a welded assembly or formed by a hydraulic press. The planing plate 140 can be made of various materials, such as, metal, aluminum, steel, plastic, and fiberglass, to name a few. In one form, the planing plate 140 is a fiberglass molded unit (foam filled) that would provide a planing surface as well as increased buoyancy.

In the illustrated embodiment shown in FIGS. 5 and 6, the planing device 100 includes a hinge connection 170 that is attached to the front end 142 of the planing plate 140 and the stiffener member 132 of the modular frame 110 to enable the rear end 144 of the planing plate 140 to rotate away from the modular frame 110 allowing the rear end 144 to move up and down. The hinge connection 170 spans between the right and the left edges 146 and 148 along the front end 142. Bolts attach the hinge connection 170 to the front end 142 of the planing plate 140 and the stiffener member 132. The hinge connection 170 can be made of stainless steel. Other embodiments include different rotatable connections between the front end 142 of the planing plate 140 and the stiffener member 132 of the modular frame 110 or between the front end 142 and the front member 112 if no stiffener member 132 is present. In any embodiment, the front end 142 of the planing plate 140 is rotatably attached to the front member 112 of the modular frame 110 such that the planing plate 140 is rotatable between a raised position wherein the rear end 144 of the planing plate 140 is above the waterline and a lowered position wherein the rear end 144 of the planing plate 140 is configured to engage the waterline to lift the pontoon boat when the adjustable planing device 100 is mounted to the underside of a pontoon boat positioned in water. In one embodiment, the rear end 144 of the planing plate 140 does not go any lower than the bottom of the pontoons when in a lowered position. In another embodiment, the rear end 144 of the planing plate 140 does go lower than the bottom of the pontoons when in a lowered position.

Figure 10:
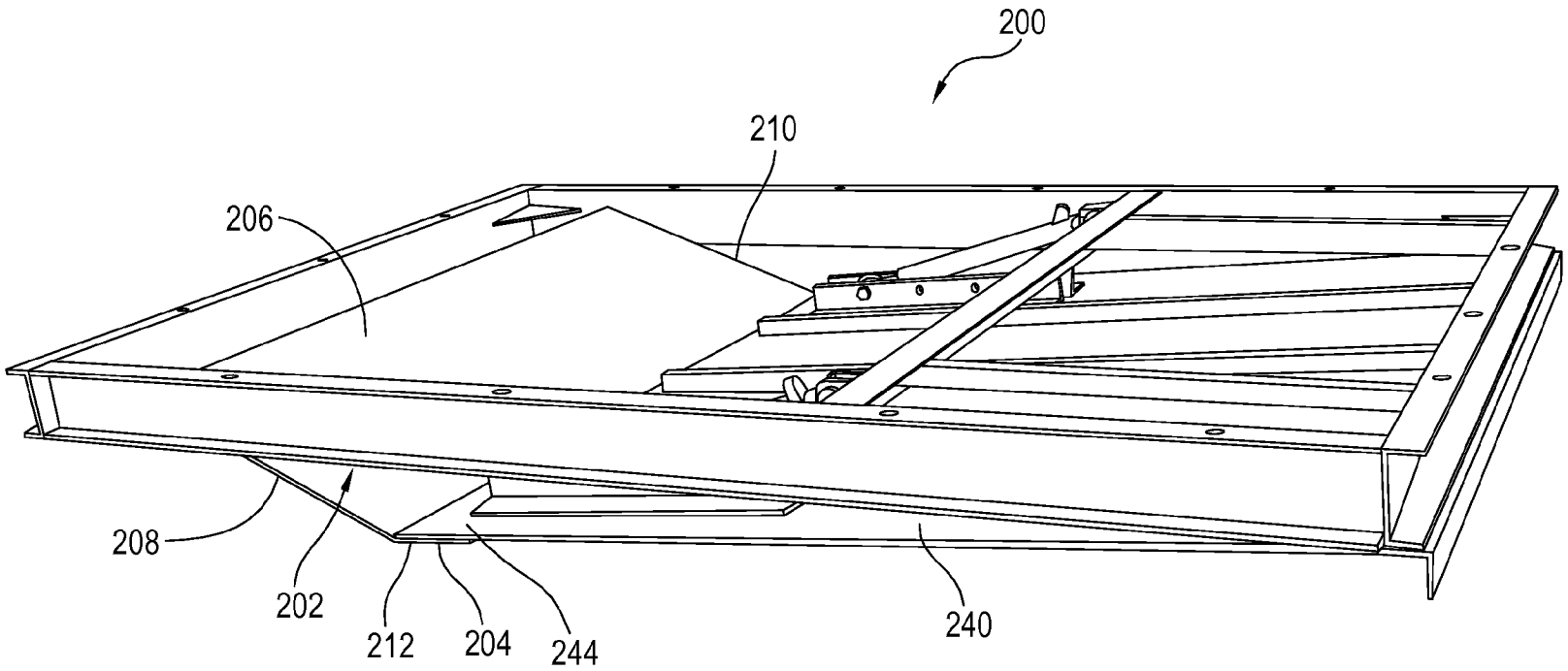
FIG. 10 is a top perspective view of a second embodiment of the adjustable planing device in a raised position.
Figure 11:
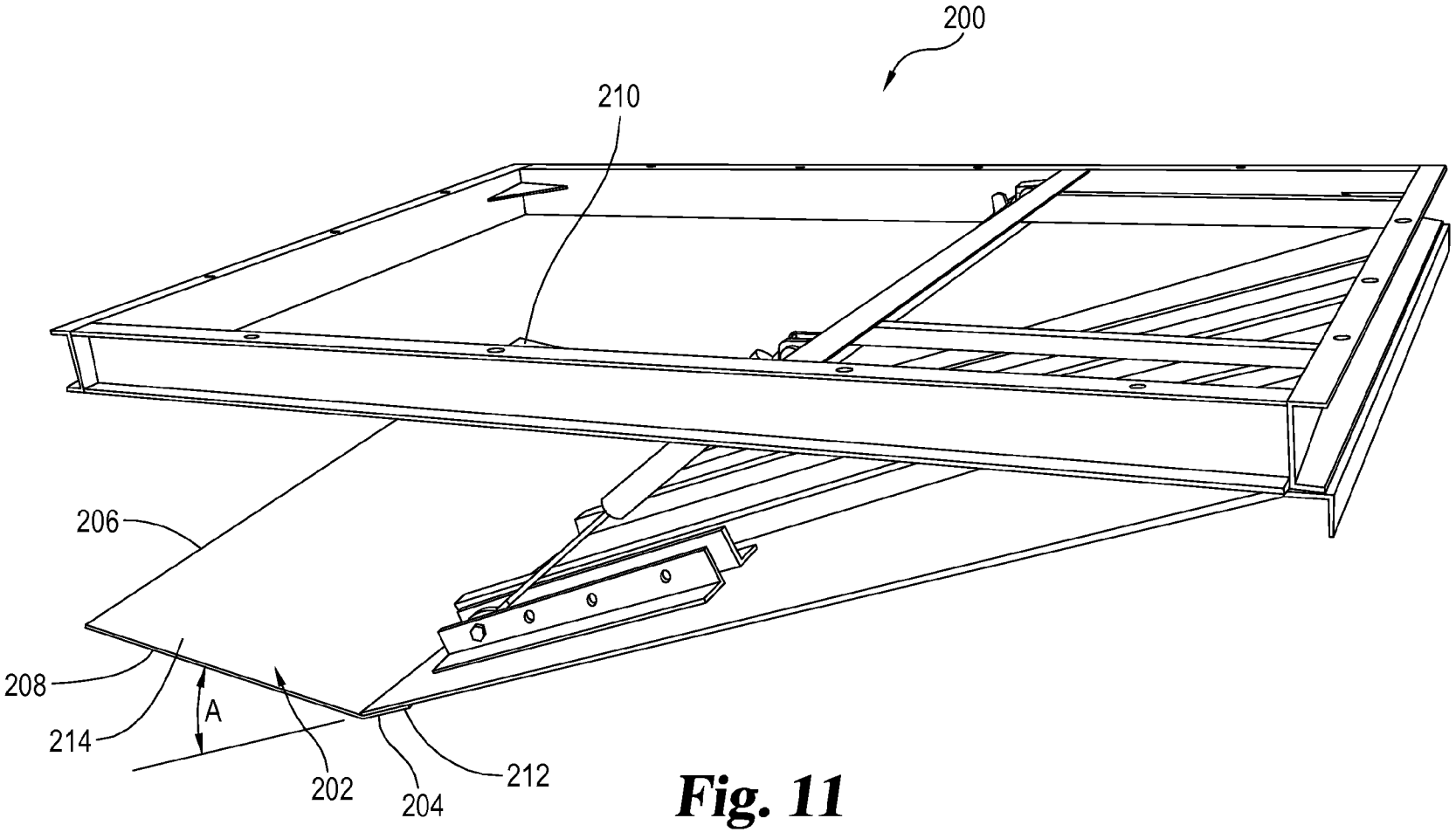
FIG. 11 is a top perspective view of the adjustable planing device from FIG. 10 in a lowered position.

A second embodiment of a planing device 200 is illustrated in FIGS. 10 and 11. The planing device 200 is similar to planing device 100 in all aspects; therefore similar details will not be described. The planing device 200 includes a skirt plate 202 attached to a planing plate 240. The skirt plate 202 has a front end 204 opposite a rear end 206 and a right edge 208 opposite a left edge 210 wherein the right and the left edges 208 and 210 span the length of the front and the rear ends 204 and 206. The front end 204 includes a toe portion 212 that spans between the right and the left edges 208 and 210, respectively. In this embodiment, the toe portion 212 is attached to a rear end 244 of the planing plate 240. The toe portion 212 can be attached to the planing plate 240 by various techniques such as welds, glue, bolts, or other mechanical fasteners. The toe portion 212 has a length that is necessary to safely attach the skirt plate 202 to the planing plate 240 to enable operation of the planing device 200 without the skirt plate 202 becoming detached from the planing plate 240. The skirt plate 202 also includes a deflector portion 214 that spans from the toe portion 212 to the rear end 206. In the illustrated embodiment, the deflector portion 214 forms an angle, A, with the toe portion 212. Angle A can vary from zero degrees to about 60 degrees and in one preferred embodiment angle A is about 30 degrees. The skirt plate 202 is attached to the planing plate 240 to provide additional surface area and thus more lift for the pontoon boat. More specifically, the skirt plate 202 is attached to the planing plate 240 to create more planing surface for a longer pontoon boat. Alternatively, for a longer pontoon boat, the planing plate 140 can be made longer.

Figure 12:
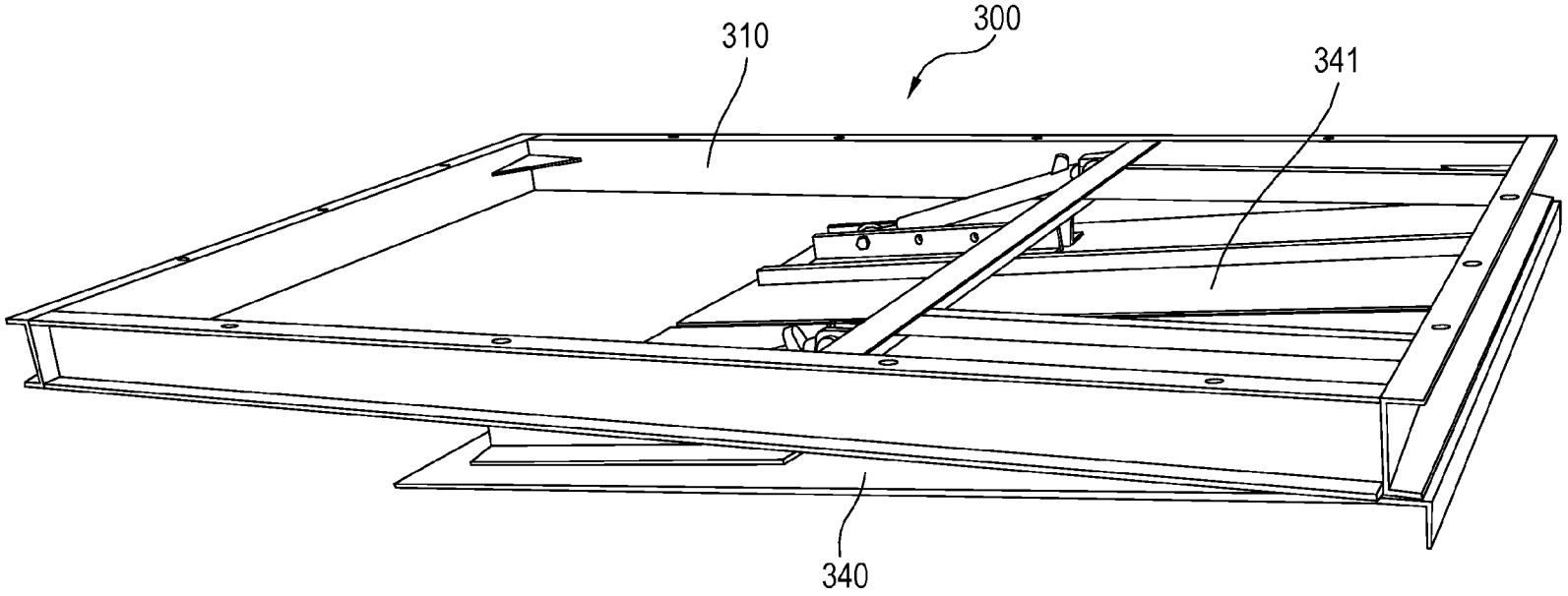
FIG. 12 is a top perspective view of a third embodiment of the adjustable planing device in a raised position.
Figure 13:
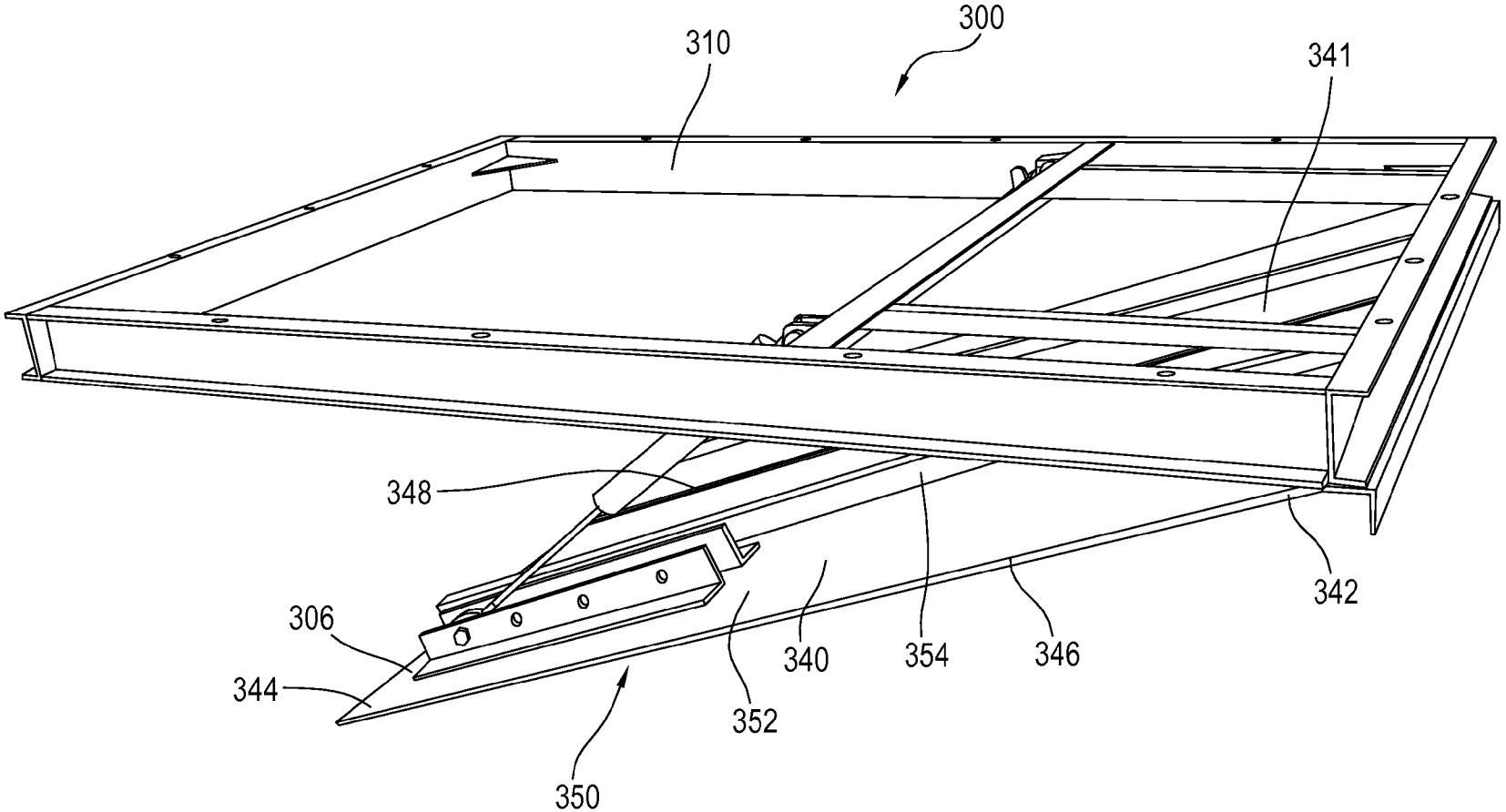
FIG. 13 is a top perspective view of the adjustable planing device from FIG. 12 in a lowered position.

A third embodiment of a planing device 300 is illustrated in FIGS. 12 and 13. The planing device 300 is similar to planing device 100 in all aspects; therefore similar details will not be described. The planing device 300 includes a first longitudinal planing plate 340 and a second longitudinal planing plate 341 arranged in a side by side orientation. The first longitudinal planing plate 340 and the second longitudinal planing plate 341 are each configured to move independently of one another. The first longitudinal planing plate 340 is similar to the second longitudinal planing plate 341; therefore, for the sake of brevity only the first longitudinal planing plate 340 is described. The length of the first longitudinal planing plate 340 is about the same as the length of the second longitudinal planing plate 341, and the width of the first longitudinal planing plate 340 is about the same as the width of the second longitudinal planing plate 341.

The first longitudinal planing plate 340 includes a front end 342 opposite a rear end 344 and a right edge 346 opposite a left edge 348 wherein the right and the left edges 346 and 348 span between the front and the rear ends 342 and 344. The first longitudinal planing plate 340 also includes a lower planing face 350 opposite an upper planing face 352 wherein the lower and the upper planing faces 350 and 352 span between the front end 342 and the rear end 344 of the first longitudinal planing plate 340. The lower planing face 350 has a substantially smooth surface to engage the waterline when the pontoon boat is in water. In the illustrated embodiment shown in FIGS. 12 and 13, the first longitudinal planing plate 340 includes a support member 354 positioned on the upper planing face 352 wherein the support member 354 is configured to reinforce the first longitudinal planing plate 340. In this form, one support member 354 is attached to the upper planing face 352; however, other configurations may include more or less support members 354. The support member 354 spans from the front end 342 to the rear end 344 but in other embodiments may have a shorter length. The support member 354 has a generally rectangular cross-sectional shape but in other embodiments the support member 354 has a channel or C shape, an I shape, an L shape, a flat plate, or any other shape that will reinforce the first longitudinal planing plate 340.

The first and the second longitudinal planing plates 340 and 341 are rotatably connected to the modular frame 310 similarly as planing plate 140 is rotatably attached to modular frame 110. For example, a hinge connection is placed between each of the first and the second longitudinal planing plates 340 and 341 such that the first and the second longitudinal planing plates 340 and 341 move independently of one another. The first and the second longitudinal planing plates 340 and 341 move individually between a raised position wherein one or both of the first or the second longitudinal planing plates 340 and 341 is elevated above the waterline and a lowered position wherein one or both of the rear end 306 and the rear end of the second longitudinal planing plate 341 engages the waterline to lift the pontoon boat.

Also similarly to planing device 100, a single hydraulic cylinder is attached to each of the first and the second longitudinal planing plates 340 and 341 and the modular frame 310. Two hydraulic cylinders enable the first and the second longitudinal planing plates 340 and 341 to operate independently of one another to provide lateral trimming and improved steering of the boat. The first and the second longitudinal planing plates 340 and 341 are controlled by two toggle switches or a joy stick controller (not illustrated).

Optionally, the planing device 300 includes a first skirt plate (not illustrated) attached to a rear end 306 of the first longitudinal planing plate 340, wherein the first skirt plate is configured to engage the waterline to lift the pontoon boat when the first longitudinal planing plate 340 is rotated to the lowered position. Optionally, the planing device 300 includes a second skirt plate (not illustrated) attached to the rear end of the second longitudinal planing plate 341, wherein the second skirt plate is configured to engage the waterline to lift the pontoon boat when the second longitudinal planing plate 341 is rotated to the lowered position. The first and the second skirt plates can each include a deflector portion that forms an angle, A, with a toe portion.

Figure 14:
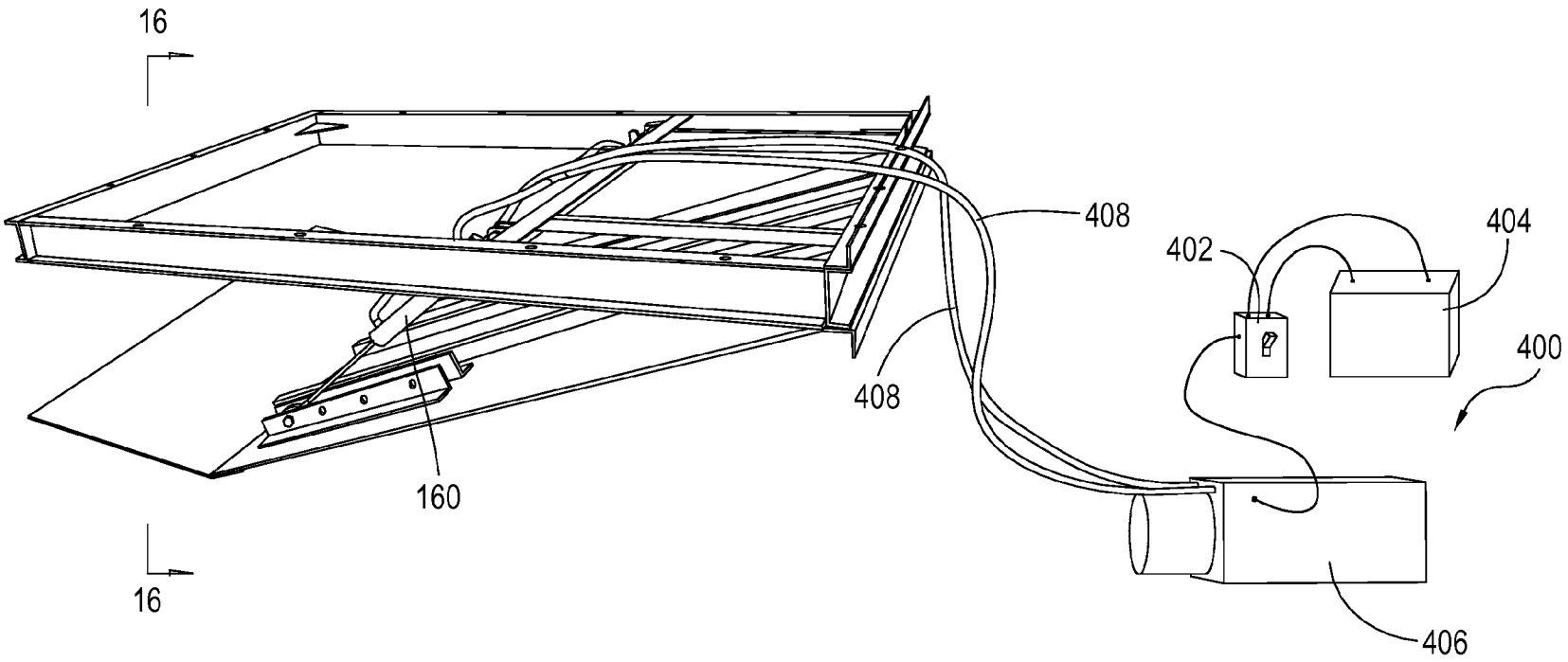
FIG. 14 is one embodiment of a hydraulic power system for any of the adjustable planing devices from FIGS. 1-13.
Figure 15:
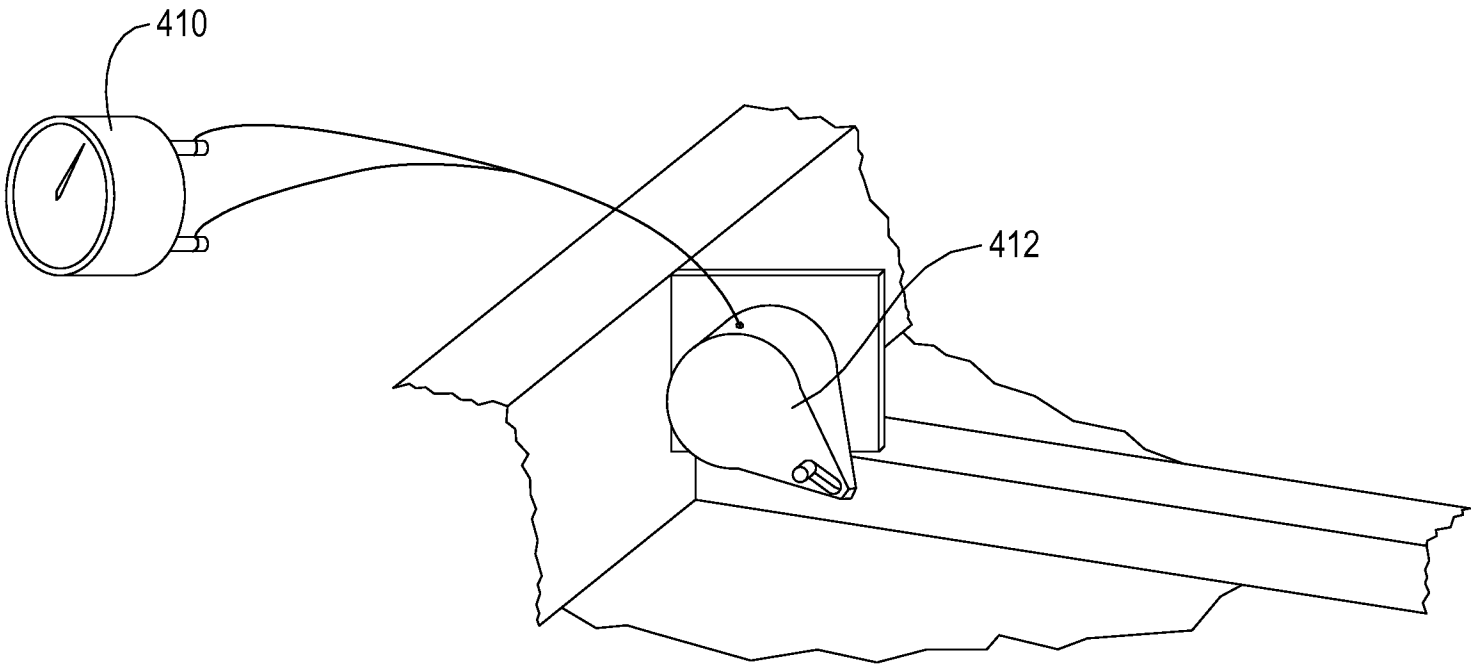
FIG. 15 is one embodiment of a trim gauge for any of the adjustable planing devices from FIGS. 1-13.
Figure 16:
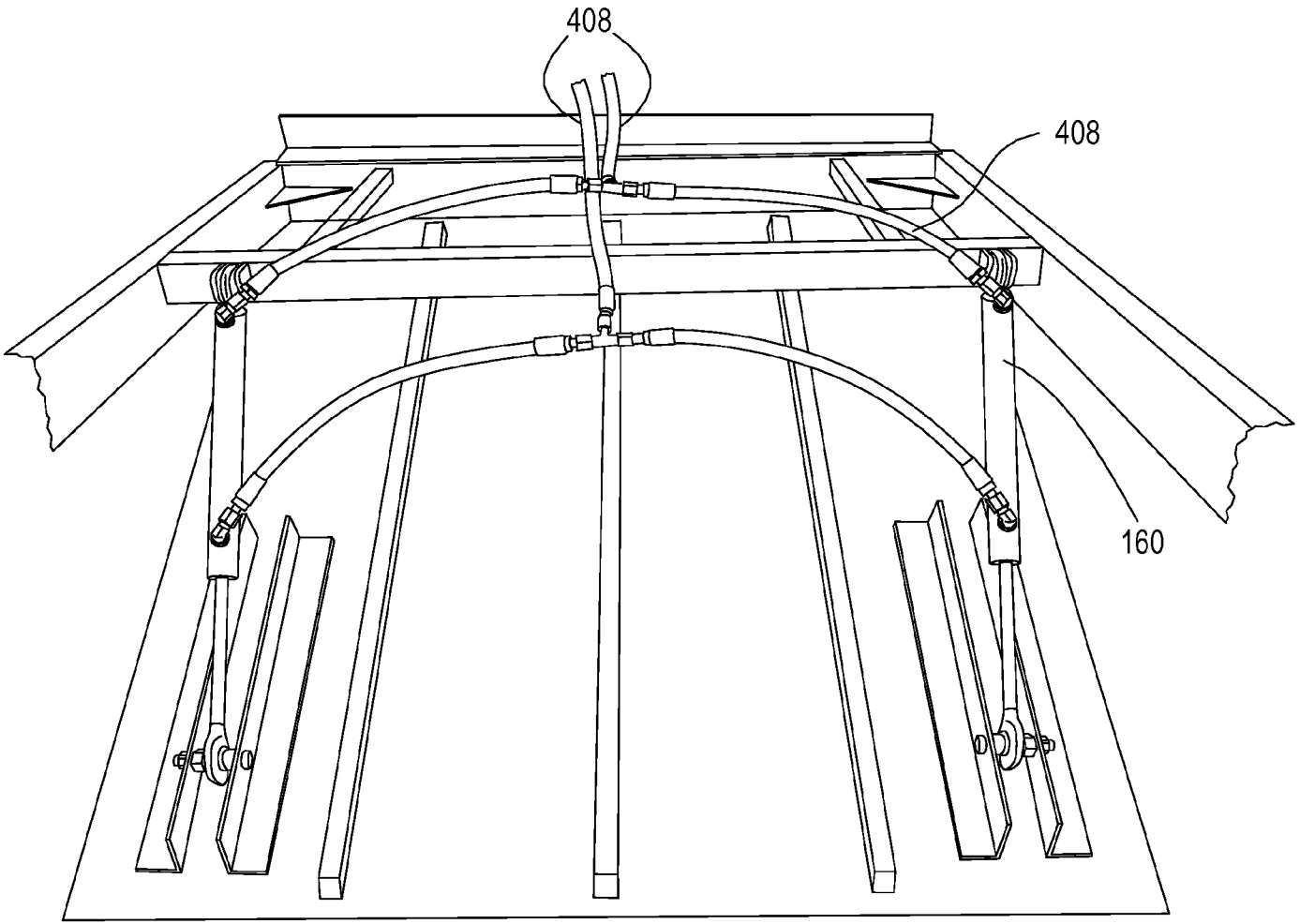
FIG. 16 is a side view of the embodiment from FIG. 14.

One embodiment of a power system 400 for any of the adjustable planing devices 100, 200, and 300, from FIGS. 1-13, is illustrated in FIGS. 14-16. Although the power system 400 is illustrated adjacent the planing device 200, some of the members of the power system 400 are typically mounted in the console dash or seat storage compartments of a boat for easy access by a boat operator when the planing device 200 is attached to a pontoon boat. One embodiment of the power system 400 includes a three way or toggle switch device 402, a battery 404, a power pump 406, and one or more hoses 408 for connection to the hydraulic cylinders 160. The power system 400 provides oil to the hydraulic cylinders 160 so the hydraulic cylinders 160 can be extended or retracted. The three way switch 402 operates in three positions, up, neutral, and down, to control the direction of the planing plate 140. In one form, the three way switch 402 is mounted on the dash of the boat to actuate the hydraulic cylinders 160. In one embodiment, the battery 404 is a 12 volt battery. When the three way switch 402 is not actuated, the power pump is 406 has an internal check valve to keep the oil trapped in the hydraulic cylinders 160 so the hydraulic cylinders 160 cannot extend or retract. For additional safety, remote or integral pilot operated check valves can be incorporated into the power system 400. A crossover relief valve can be added to allow oil to transfer from the rod side to the piston side of the hydraulic cylinders 160. This will provide an action much like a shock absorber in the event that the planing plate 140 strikes an underwater object to help prevent damage to the adjustable planing device 100. In one embodiment, the hydraulic oil used in the power system 400 is a food grade type so that in the event there is a hydraulic oil leak, there is no damage to the environment. Beneficially, this type of connection makes the planing devices described above a green machine or environmentally friendly machine. In an alternate embodiment, the power system 400 includes a gauge 410 connected with a sensor 412 to indicate the optimum position of the planing plate 140 based on different loads or weight of the passengers, gear, and other contents of the pontoon boat. Typically, the gauge 410 is mounted in the operator's control panel of the pontoon boat.

DEFINITIONS AND ALTERNATIVES

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to the following terms or common variations thereof:

Lowered position—includes the elevation of the planing plate relative to the waterline when the planing device is attached to a boat. The lowered position is measured relative to the rear end of the planing plate wherein the rear end of the planing plate engages the waterline to lift the pontoon boat. In one example, the rear end of the planing plate is not any lower than the bottom of the pontoons of a pontoon boat when in a lowered position. In another example, the rear end of the planing plate is lower than the bottom of the pontoons of a pontoon boat when in a lowered position.

Midship region—refers to the location of a boat or a pontoon boat that spans between a front end and a rear end of the boat or pontoon boat. In one example, the midship region includes the center of the boat or pontoon boat and extends equidistantly from the center towards the front end and the rear end of the boat. In another example, the midship region includes the center of the boat or pontoon boat and extends a first distance from the center towards the front end and extends a second distance from the center towards the rear end wherein the first distance is not equal to the second distance.

Modular frame—includes a structure that is configured to directly or indirectly attach to a boat. The modular frame can have a unitary construction or can be made from multiple pieces coupled together. In one example, the modular frame includes four components, a front member, a rear member, a right member, and a left member, but in other examples the modular frame can include more than four components. In another example, the modular frame includes one component such as a front member that is configured to couple with a planing plate and the front member is configured to attach to a boat.

Planing plate—includes a structure having a front end opposite a rear end wherein the front end is configured to rotatably attach to the modular frame and the rear end is configured to engage the waterline. The planing plate can have a unitary construction or can be made from multiple pieces coupled together. In one example, the planing plate is a single element. In other examples, the planing plate includes one, two, three, or more elements that can operate independently of each other or the multiple elements are attached together to operate as a single element.

Raised position—includes the elevation of the planing plate relative to the waterline when the planing device is attached to a boat. The raised position is measured relative to the rear end of the planing plate wherein the rear end of the planing plate is above the waterline and does not engage the water.

Rotation—the act or process of moving or turning around a point or axis.

It should be noted that the singular forms "a", "an", "the", and the like as used in the description and/or the claims include the plural forms unless expressly discussed otherwise. For example, if the specification and/or claims refer to "a device" or "the device", it includes one or more of such devices.

It should be noted that directional terms, such as "upper", "lower", "top" "bottom", "first", "second", "front", "rear", etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation unless stated otherwise in the application.

The above assemblies and components may be made by any materials and processes apparent to be suitable. In particular, the modular frame, planing plate, skirt plate, first longitudinal planing plate, and second longitudinal planing plate may include a metal, a plastic, a composite material such as carbon fiber, a fiber reinforced material, or a combination of some or all of these materials.

Additionally, variations on the above-described assemblies, components, and features are contemplated. For example, the modular frame may be modified to attach to a boat in a different manner than disclosed.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. An adjustable planing device for a pontoon boat, the pontoon boat having a midship region that spans between a front end and a rear end, the adjustable planing device comprising:

a modular frame having a front member opposite a rear member, a right member opposite a left member, and a cross member, wherein the right and left members, respectively, span between the front member and the rear member, and the cross member extends between the right and the left members, and wherein the modular frame is configured to attach to the midship region of the pontoon boat;

a planing plate having a front end opposite a rear end, the front end of the planing plate is rotatably attached to the front member of the modular frame such that the planing plate is rotatable between a raised position wherein the rear end of the planing plate is above the waterline and a lowered position wherein the rear end of the planing plate is configured to engage the waterline to lift the pontoon boat; and means for moving the planing plate wherein the means for moving is attached to the cross member at a location between the right and left members.

2. The adjustable planing device of claim 1 further comprising:

is a skirt plate attached to the rear end of the planing plate, wherein the skirt plate is configured to engage the waterline to lift the pontoon boat when the planing plate is rotated to the lowered position.

3. The adjustable planing device of claim 2 wherein the skirt plate forms an angle with the planing plate.

4. The adjustable planing device of claim 1 wherein the planing plate includes a first longitudinal planing plate and a second longitudinal planing plate, wherein the first longitudinal planing plate is parallel to the second longitudinal planing plate such that a front end of the first longitudinal planing plate is aligned with a front end of the second longitudinal planing plate.

5. The adjustable planing device of claim 4 wherein the first longitudinal planing plate and the second longitudinal planing plate are each configured to move independently of one another.

6. The adjustable planing device of claim 4 wherein the length of the first longitudinal planing plate is about the same as the length of the second longitudinal planing plate.

7. The adjustable planing device of claim 1 wherein the means for moving the planing plate includes a hydraulic cylinder attached to both the cross member and the planing plate.

8. The adjustable planing device of claim 1 wherein the planing plate includes a lower planing face opposite an upper planing face, the lower and the upper planing faces, respectively, span between the front end and the rear end of the planing plate, and the upper planing face includes a plurality of spaced support members configured to reinforce the planing plate.

9. An adjustable planing device for a pontoon boat, the pontoon boat having a midship region that spans between a front end and a rear end, the adjustable planing device comprising:

a modular frame having a front member opposite a rear member, a right member opposite a left member, and a cross member, wherein the right and left members, respectively, span between the front member and the rear member, and the cross member extends between the right and the left members, and wherein the modular frame is configured to attach to the midship region of the pontoon boat;

a planing plate having a front end opposite a rear end, the front end of the planing plate is hingedly attached to the front member of the modular frame such that the planing plate is movable between a raised position wherein the rear end of the planing plate is above the waterline and a lowered position wherein the rear end of the planing plate is configured to engage the waterline to lift the pontoon boat; and a hydraulic cylinder connected to both the cross member and the planing plate, wherein the hydraulic cylinder is attached to the cross member at a location between the right and left members, and the hydraulic cylinder is operable to move the planing plate.

10. The adjustable planing device of claim 9, further comprising:

a skirt plate attached to the rear member of the planing plate, wherein the skirt plate is configured to engage the waterline to lift the pontoon boat when the planing plate is moved to the lowered position.

11. The adjustable planing device of claim 10 wherein the skirt plate forms an angle with the planing plate.

12. The adjustable planing device of claim 11 wherein the angle is about 30 degrees.

13. The adjustable planing device of claim 9 wherein the planing plate includes a first longitudinal planing plate and a second longitudinal planing plate arranged in a side by side orientation, and the first longitudinal planing plate and the second longitudinal planing plate are each configured to move independently of one another.

14. The adjustable planing device of claim 9 wherein the modular frame is made of aluminum.

15. The adjustable planing device of claim 9 wherein the planing plate includes a lower planing face opposite an upper planing face, the lower and the upper planing faces, respectively, span between the front end and the rear end, the lower planing face being substantially flat, and the upper planing face includes a plurality of spaced support members configured to reinforce the planing plate.

16. An adjustable planing device for a pontoon boat, the pontoon boat having a midship region that spans between a front end and a rear end, the adjustable planing device comprising:

a modular frame having a front member opposite a rear member, a right member opposite a left member, and a cross member, wherein the right and left members, respectively, span between the front member and the rear member, and the cross member extends between the right and the left members, and the modular frame detachably mounted to the midship region of the pontoon boat;

a first longitudinal planing plate and a second longitudinal planing plate arranged in a side by side orientation, the first and the second longitudinal planing plates rotatably mounted to the modular frame, and the first and the second longitudinal planing plates are each configured to move independently of one another between a raised position wherein the first or the second longitudinal planing plates is elevated above the waterline and a lowered position wherein a portion of the first longitudinal planing plate or a portion of the second longitudinal planing plate engages the waterline to lift the pontoon boat;

a first hydraulic cylinder attached to the cross member and the first longitudinal planing plate; and a second hydraulic cylinder attached to the cross member and the second longitudinal planing plate, wherein the first and second hydraulic cylinders are each attached to the cross member at a location between the right and the left members.

17. The adjustable planing device of claim 16 further comprising:

a first skirt plate attached to a rear end of the first longitudinal planing plate, wherein the first skirt plate is configured to engage the waterline to lift the pontoon boat when the first longitudinal planing plate is rotated to the lowered position; and a second skirt plate attached to a rear end of the second longitudinal planing plate, wherein the second skirt plate is configured to engage the waterline to lift the pontoon boat when the second longitudinal planing plate is rotated to the lowered position.

18. The adjustable planing device of claim 16 wherein the length of the first longitudinal planing plate is about the same as the length of the second longitudinal planing plate.

* * * * *

UNITED STATES PATENT AND TRADEMARK OFFICE

CERTIFICATE OF CORRECTION

PATENT NO. : 8,955,452 B1
APPLICATION NO. : 14/219580
DATED : February 17, 2015
INVENTOR(S) : Harley Wilson It is certified that error appears in the above-identified patent and that said Letters Patent is hereby corrected as shown below:

In the Claims
Col. 10, Claim 2, line 9, replace "is a skirt plate attached to the rear end of the planing plate," with
--a skirt plate attached to the rear end of the planing plate,--

Signed and Sealed this
Nineteenth Day of May, 2015

Michelle K. Lee

Michelle K. Lee
*Director of the United States Patent and Trademark Office*